US005460912A

United States Patent [19]

Yamamoto et al.

[11] Patent Number: 5,460,912

[45] Date of Patent: Oct. 24, 1995

[54] ELECTROPHOTOGRAPHY TYPE LITHOGRAPHIC FORM PLATE FOR LASER BEAM

[75] Inventors: Hideyuki Yamamoto; Kazumasa Hijikata, both of Hachioji, Japan

[73] Assignee: Iwatsu Electric Co., Ltd., Tokyo, Japan

[21] Appl. No.: 72,338

[22] Filed: Jun. 4, 1993

[30] Foreign Application Priority Data

Jul. 14, 1992 [JP] Japan ..... 4-186846

[51] Int. Cl.[6] ..... G03G 5/09; G03G 5/05

[52] U.S. Cl. ..... 430/93; 430/96

[58] Field of Search ..... 430/93, 92, 83, 430/96

[56] References Cited

U.S. PATENT DOCUMENTS

| | | | |
|---|---|---|---|
| 3,619,154 | 11/1971 | Cavagna et al. . | |
| 3,682,630 | 8/1972 | Park . | |
| 4,308,334 | 12/1981 | Kinoshita et al. | 430/96 |
| 4,418,135 | 11/1983 | Beeson et al. | 430/93 |
| 4,879,195 | 11/1989 | Toyofuku et al. | 430/93 |
| 4,929,527 | 5/1990 | Kato et al. | 430/93 |

FOREIGN PATENT DOCUMENTS

| | | |
|---|---|---|
| 1-222266 | 9/1989 | Japan . |
| 2-28143 | 6/1990 | Japan . |
| 3-100560 | 4/1991 | Japan . |
| 3-100559 | 4/1991 | Japan . |
| 4-757 | 1/1992 | Japan . |
| 4-35757 | 6/1992 | Japan . |

*Primary Examiner*—Christopher D. Rodee
*Attorney, Agent, or Firm*—Paul & Paul

[57] ABSTRACT

The present invention is to provide an electrophotography type lithographic form plate having a high sensitivity and a superior photosensitive characteristic as a photosensitive material for a semiconductor laser beam as well as having an excellent printability as a lithographic form plate. The form plate comprises an electroconductive support member and a photosensitive layer formed thereon and containing a sensitizer mainly consisting of zinc oxide and a binder resin, wherein the sensitizer is at least one compound selected from a group of dye compounds represented by the following general formula (I), and a total acid value of the binder resin is within a range of 3.0 through 10.0.

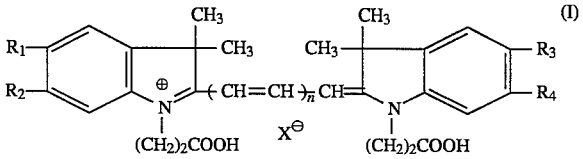

wherein, in the above formula, n represents 2 or 3; $R_1$, $R_2$, $R_3$ and $R_4$ represent hyrogen atoms, lower alkyl groups, lower alkoxy groups, or halogen atoms, and X–represents an acid anion.

15 Claims, No Drawings

ELECTROPHOTOGRAPHY TYPE LITHOGRAPHIC FORM PLATE FOR LASER BEAM

BACKGROUND OF THE INVENTION

1. Field of the Invention

The present invention relates to an electrophotography type lithographic form plate, having a high sensitivity and a superior photosensitive characteristic, as a photosensitive material for a semiconductor laser beam which also has excellent printability as a lithographic form plate.

2. Description of the Prior Art

An electrophotographic sensitive material is used for forming an image by a general electrophotographic process, i.e., charging, exposing and developing. Further, a method for using the same, after the image formation, as a form plate for a lithographic printing has been widely used in practice. Such a photosensitive material for an electrophotography type lithographic form plate is one spectrally sensitized to the visible light from a halogen lamp.

Recently, techniques for electronic editing using a semiconductor laser have been developed, whereby a laser printer capable of outputting a document directly from a computer has been practically used. In addition, the range of wavelengths available from a semiconductor laser is being increased from the near infrared region to the visible region. Thereby there have been many developments of electrophotographic sensitive materials for a semiconductor laser beam. Also there has been much research into a printing form plate which is spectrally sensitized to a semiconductor laser beam, so as to form a form plate member directly from a computer.

Electrophotographic sensitive materials using zinc oxide and having a high sensitivity to wavelengths in the near infrared region (700 nm through 1000 nm) are disclosed, for example, in Japanese Unexamined Patent Publication (Kokai) Nos. 49-5034, 59-78358, 59-22053, 61-275760 and 62-220962.

Such electrophotographic sensitive material using zinc oxide is spectrally sensitized by using polymethinic cyanin dye as a sensitizer. When a cyanin dye contained in a silver salt sensitive agent was originaly used for the spectral sensitization, the sensitization effect was too small to be put into practical use.

There has been a proposal in which, as an improved sensitive agent for zinc oxide, an acid radical (—COOH, —$SO_3H$) is introduced into polymethinic cyanin dye, because a substance with acid radical is known to have a high sensitivity. However, while a little increase in sensitization is produced, the sensitivity does not reach a level suitable for practical use. In addition, there are problems of a falling charge amount and a deterioration in the charge retaining factor which are important electric characteristics for a photosensitive material. Also since cyanin dye has a low shelf-life and is affected by light and heat it could not be put to practical use.

For the improvement thereof, the use of additive has been studied, as disclosed, for example, in Japanese Unexamined Patent Publication (Kokai) Nos. 58-42055, 58-58554, 58-59453, 60-26949 and 1-222266. Further an electrophotographic sensitive material having a cyanin dye construction and an improved shelf-life is disclosed in Japanese Unexamined Patent Publication (Kokai) No. 57-46245.

This improved sensitive material, however, still has problems of falling of charge amount and deterioration in the charge retaining factor, whereby there is none which can be put to practical use from the view point of sensitivity and/or shelf-life.

In the past, even in photosensitive materials developed as an electrophotography type lithographic form plate, there is none which has been further studied regarding desensitization or printing durability.

Tests were conducted on the above improved electrophotographic sensitive material as a lithographic form plate with the following results.

Equal tinting appears all over a non-image area of a printed product when the form plate is processed twice because it becomes having a desensitized, technique used to avoid desensitization of the plate. Even a hand etching treatment having a low desensitization effect may cause tinting to appear on the non-image area of a printed product, and it is impossible to put such material to practical use as a lithographic form plate.

Accordingly, it is an object of the present invention to provide an electrophotography type lithographic form plate having a high sensitivity to semiconductor laser beam with wavelength of 780 nm and 670 nm, superior electrical characteristics, a stability to environmental change, and an improved shelf-life, as well as having an excellent printability as a lithographic form plate and a favorable fat immunity for preventing the generation of tinting in a non-image area of a printed product.

SUMMARY OF THE INVENTION

The above object of the present invention is achievable by an electrophotography type lithographic form plate comprising an electroconductive support member and a photosensitive layer formed thereon and containing a sensitizer mainly consisting of zinc oxide and a binder resin, wherein the sensitizer is at least one compound selected from a group of dye compounds represented by the following formula (I), and a total acid value of the binder resin is within a range of 3.0 through 10.0.

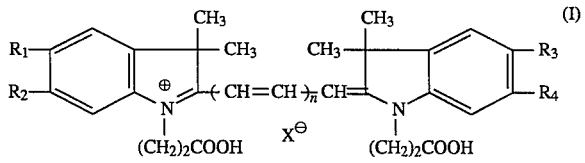

(I)

Wherein, in the above formula, n represents 2 or 3; $R_1$, $R_2$, $R_3$ and $R_4$ represent hydrogen atoms, lower alkyl groups, lower alkoxy groups, or halogen atoms, and X– represents an acid anion.

The acid anion that X– represents could be, for example, a chlorine anion, a bromine anion, an iodine anion, a thiocyanate, a methylsulfate, an ethylsulfate, a benzenesulfonate, a p-toluenesulfonate, a perchlorate anion, or and acetate.

It is well-known in the technical field of color sensitizer that inner salt which can be represented by a formula in which X– is removed from dye compound (carboxyl group is replaced by —COO—) of the general formula (I) is included in the sensitizers to be used in the present invention.

The sensitizer used in the present invention is a particular polymethinic cyanine dye represented by the above formula (I) characterized in comparison with other polymethinic cyanin dyes by a high sensitivity to laser beam light having wavelength of 780 nm and 670 nm. Also it has a high sensitization effect even though a content thereof to zinc oxide is very small, as little as one tenth through one fourth of the amount in the sensitizer spectrally sensitized to visible radiation from a halogen lamp and conventionally used for an electrophotography type lithographic form plate, such as Rose Bengal, Eosine, or Bromophenol Blue. Also, the sensitizer used for the present invention is advantageous even compared to other polymethinic cyanin dye because it has a high sensitization effect at a low concentration.

DETAILED DESCRIPTION OF THE INVENTION

If polymethinic cyanin dye is used, having a constitution other than the general formula (I) of the present invention or sensitizer having acid group of —$SO_3H$ group or carboxyalkyl group (such as —$CH_2COOH$, —$(CH_2)_3COOH$) other than defined by the general formula (I), the sensitivity to wavelength at 780 nm and 670 nm, the charge amount, the charge retaining factor and the shelf stability become inferior.

It is preferable to use 0.001 part through 0.03 part by weight, more favorably 0.003 part through 0.02 part by weight, of the sensitizer defined by the general formula (I) relative to 100 part by weight of zinc oxide. If the content of sensitizer is less than the lower limit, the sensitization effect is insufficient. Contrarily, if the content of the sensitizer is more than the upper limit, the charge amount, the charge retaining factor and the shelf stability fall.

Resins used as a binder for the present invention are those generally used for the electrophotography type lithographic form plate containing zinc oxide, such as acrylic resin of acrylic acid ester itself and/or copolymer thereof, alkyd resin, silicone resin, styrene resin, vinyl acetate resin, or urethane resin. Acrylic resin having a lower average molecular weight (for example, $10^3$ through $3\times10^4$) and a higher acid value (for example, 10 through 100) may be used. As copolymeric unsaturated acid for increasing the acid value in resin, there are α.β-ethylenic unsaturated carbonic acids such as acrylic acid, methacrylic acid, itaconic acid or α-methylene glutaric acid; other copolymeric carbonic acids such as crotonic acid or maleic acid; or hydroxyalkylesters of α.β-ethylenic unsaturated carbonic acid such as hydroxyalkyl(metha)acrylate.

According to the present invention, it is possible to solve the problems of inferior charge amount, charge retaining factor and shelf stability in the electrophotography type lithographic form plate in which polymethinic cyanin dye is used as a sensitizer, by combining a sensitizer defined by the general formula (I) and having a higher sensitization effect even if the content thereof relative to zinc oxide is low and using a binder resin having a total acid value in a range of 3.0 through 10.0, without an adverse effect on the sensitizing function of the sensitizer. Also, it has been found that this electrophotography type lithographic form plate has an excellent stability against the environmental changes and a favorable desensitization.

Since the sensitizer known in the prior art and used in a photosensitive layer for an electrophotography type lithographic form plate (Rose Bengal, Bromophenol Blue) has its own superior shelf stability and is contained in a larger amount, it is surmised that the sensitization effect and the shelf stability are not adversely influenced by the acid value of resin. Contrarily, since the content of the sensitizer is extremely small in the present invention, according to the technical common sense, there might be a possibility in that the sensitization effect, the electric characteristics and the shelf stability may be influenced by the acid value of resin.

However, there is none of such adverse effects in the present invention, provided the content of copolymeric unsaturated acid is controlled so that a total acid value in the binder resin is within a range of 3.0 through 10.0, preferably 4.0 through 9.0. If the total acid value of the binder resin used in the present invention is less than 3.0, the charge retaining factor, an image-forming ability at lower temperature and humidity, and the print durability become inferior although the sensitivity is elevated. If the total acid value exceeds 10.0, the shelf stability, the image-forming ability at higher temperature and humidity falls and the tinting in non-image area of the printed product increases.

The content of binder resin used is within a range of 10 part through 50 part in weight, preferably 15 part through 30 part in weight relative to 100 part in weight of zinc oxide.

Zinc oxide used in the present invention is one having the photoconductivity generally used in the electrophotography type lithographic form plate.

The photosensitive layer according to the present invention can be used, if necessary, with various known additives for an electrophotographic sensitive layer such as chemical sensitizers which are, for example, electron receptacle compound (halogen, benzoquinone, chloranil, acid dehydride, organic carbonic acid), polyarylalkane compound, hinded-phenol compound, and p-phenylenediamine compound.

The content of these various additives is decided not to worsen the electric characteristics, the shelf-life and the desensitization and usually 0.001 part through 2.0 part by weight relative to 100 part by weight of zinc oxide.

The photosensitive layer according to the present invention can be provided on a publicly known electroconductive supporting member.

The electroconductive supporting member may be, for example, a metallic sheet such as aluminum; a substrate formed by paper, plastic sheet or composite thereof and impregnated with low resistance substance to be electroconductive; a substrate having an electroconductivity on a rear surface (a surface opposite to a photosensitive layer surface) and coated with at least one layer for improving the moisture durability and preventing from curling; the abovesaid supporting member on which a waterproof coat is provided; the abovesaid supporting member on which at least one precoating layer is provided; and a plastic substrate with a coat of evaporated aluminum or the like and laminated with paper.

The electrophotography type lithographic form plate of the present invention can be manufactured by publicly known methods. For example, predetermined amounts of zinc oxide, binder resin and sensitizer are dispersingly mixed together in an organic solvent such as toluene or xylene by means of a ball mill, sand glider or the like to form a paint. In this mixing/dispersing process, zinc oxide and sensitizer may be premixed, or only the sensitizer may be dissolved in the organic solvent and thereafter mixed with zinc oxide and binder resin. There is no special mixing/dispersing method in the manufacturing process of the sensitizer according to the present invention.

Then the paint thus prepared is coated on the electroconductive support member. After the same is dried, the aimed electrophotography type lithographic form plate can be obtained.

EXAMPLES

Examples of the present invention will be described below. However, it should be noted that the present invention is not restricted thereto.

Sensitizer: A-1

In the general formula (I), n represents 3; $R_1$, $R_3$ represent —$CH_3$; $R_2$, $R_4$ represent —H; and X– represents iodine anion.

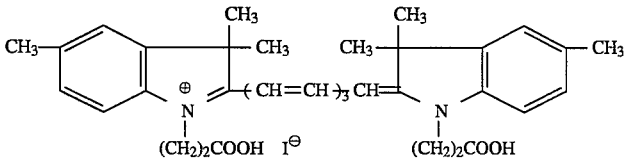

Sensitizer: A-1

In the general formula (I), n represents 3; $R_1$, $R_2$, $R_3$, $R_4$ represent —H; and X– represents iodine anion.

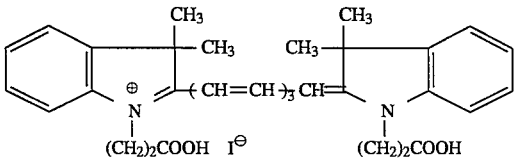

Sensitizer: A-3

In the general formula (I), n represents 2; $R_1$, $R_2$, $R_3$, $R_4$ represent —H; and X– does not exists; that is, this is an inner salt.

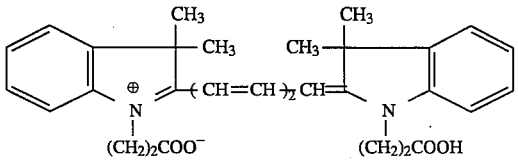

Sensitizer: A-4 a dye having an acid group different from that of the general formula (I).

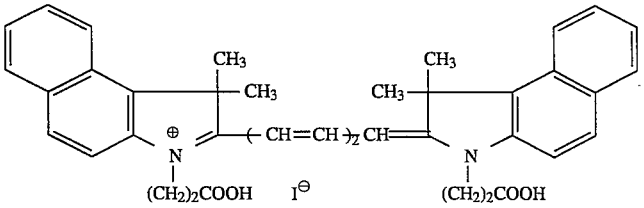

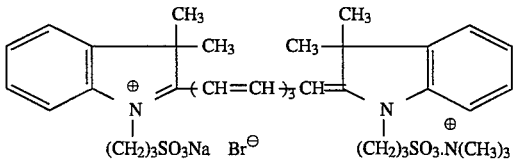

Sensitizer: A-5 a dye having an acid group different from that of the general formula (I).

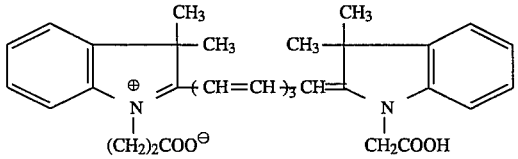

Sensitizer: A-6 a dye having cyanin dye skeletal structure different from that of the general formula (I).

Sensitizer: A-7 a dye having cyanin dye skeletal structure different from that of the general formula (I).

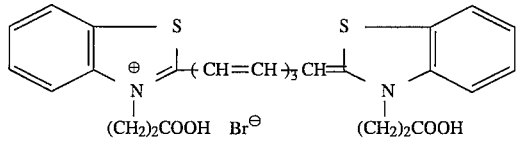

Sensitizer: A-8

In the general formula (I), n represents 2; $R_1$, $R_3$ represent —H; $R_2$, $R_4$ represent —Cl; and X– does not exist; that is, this is an inner salt.

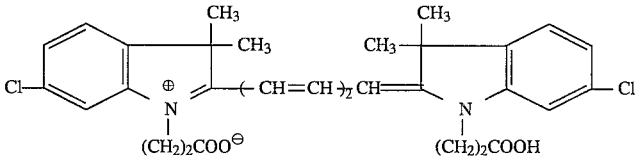

Sensitizer: A-9

In the general formula (I), n represents 3; $R_1$, $R_3$ represent —$OCH_3$; $R_2$, $R_4$ represent —H; and X– represents iodine anion.

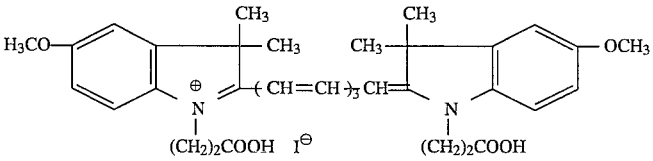

Synthesis of binder resin 1: B-1

A resinous solution was obtained by the following composition through a solution polymerization while adding a suitable amount of initiator, which solution is transparent and has a solid content of 50% and an acid value of resin of 5.2:

| | |
|---|---|
| methyl methacrylate | 56 part by weight |
| n-butyl methacrylate | 36 part by weight |
| acrylic acid | 6 part by weight |
| toluene | 100 part by weight |

Remark 1) acid value of resin: a weight of potassium hydroxide represented by mg required for neutralizing acid contained in a sample of 1 g, while using phenolphthalein as an indicator.

Synthesis of binder resin 2: B-2

A resinous solution was obtained by the following composition through a solution polymerization while adding a suitable amount of initiator, which solution is transparent and has a solid content of 50% and an acid value of resin of 6.1:

| | |
|---|---|
| methyl methacrylate | 56 part by weight |
| n-butyl methacrylate | 36 part by weight |
| acrylic acid | 7 part by weight |
| toluene | 100 part by weight |

Synthesis of binder resin 3: B-3

A resinous solution was obtained by the following composition through a solution polymerization while adding a suitable amount of initiator, which solution is transparent and has a solid content of 50% and an acid value of resin of 8.0:

| | |
|---|---|
| methyl methacrylate | 58 part by weight |
| ethyl acrylate | 38 part by weight |

-continued

| | |
|---|---|
| methacrylic acid | 9 part by weight |
| toluene | 100 part by weight |

Synthesis of binder resin 4: B-4

A resinous solution was obtained by the following composition through a solution polymerization while adding a suitable amount of initiator, which solution is transparent and has a solid content of 50% and an acid value of resin of 3.3:

| | |
|---|---|
| 2-ethylhexyl methacrylate | 58 part by weight |
| ethyl acrylate | 33 part by weight |
| methacrylic acid | 4 part by weight |
| toluene | 100 part by weight |

Synthesis of binder resin 5: B-5

A resinous solution was obtained by the following composition through a solution polymerization while adding a suitable amount of initiator, which solution is transparent and has a solid content of 50% and an acid value of resin of 9.7:

| | |
|---|---|
| 2-ethylhexyl methacrylate | 52 part by weight |
| ethyl acrylate | 33 part by weight |
| acrylic acid | 10 part by weight |
| toluene | 100 part by weight |

Synthesis of binder resin 6: B-6

A resinous solution was obtained by the following composition through a solution polymerization while adding a suitable amount of initiator, which solution is transparent and has a solid content of 50% and an acid value of resin of 2.1:

| | |
|---|---|
| Methyl methacrylate | 60 part by weight |
| n-butyl methacrylate | 40 part by weight |
| acrylic acid | 3 part by weight |
| toluene | 100 part by weight |

Synthesis of binder resin 7: B-7

A resinous solution was obtained by the following composition through a solution polymerization while adding a suitable amount of initiator, which solution is transparent and has a solid content of 50% and an acid value of resin of 11.3:

| | |
|---|---|
| methyl methacrylate | 45 part by weight |
| ethyl acrylate | 35 part by weight |
| methacrylic acid | 13 part by weight |
| toluene | 100 part by weight |

Synthesis of binder resin 8: B-8

A resinous solution was obtained by the following composition through a solution polymerization while adding a suitable amount of initiator, which solution is transparent and has a solid content of 50% and an acid value of resin of 12.5:

| | |
|---|---|
| methyl methacrylate | 45 part by weight |
| ethyl acrylate | 35 part by weight |
| acrylic acid | 15 part by weight |
| toluene | 100 part by weight |

Next, the present invention will be explained in more detail with reference to Examples 1 through 5 and Comparative Examples A through G.

Example 1

A paint for photoconductive layer was prepared from the following mixture dispersed in a ball mill for two hours:

| | |
|---|---|
| sensitizer A-1 (1% methanol solution) | 1 part by weight |
| binder B-1 | 40 part by weight |
| photoconductive zinc oxide | 100 part by weight |
| toluene | 100 part by weight |

The paint was coated by a wire bar on an electrophotography substrate (a water-proofed lithographic form plate) treated to be electroconductive so that a dry weight thereof is 20 g/m$^2$, then dried for 1 min at 100° C., and maintained in a dark place for 24 hours under a condition of 20° C. and 60% RH to obtain an electrophotography type lithographic form plate.

Example 2

An electrophotography type lithographic form plate was obtained in the same process as Example 1, except for using 2 part by weight of sensitizer A-2 instead of A-1 and binder resin B-2 instead of B-1.

Example 3

An electrophotography type lithographic form plate was obtained in the same process as Example 1, except for using 1 part by weight of sensitizer A-3 instead of A-1 and binder resin B-3 instead of B-1.

Example 4

An electrophotography type lithographic form plate was obtained in the same process as Example 1, except for using binder resin B-4 instead of B-1.

Example 5

An electrophotography type lithographic form plate was obtained in the same process as Example 1, except for using binder resin B-5 instead of B-1.

Example 6

An electrophotography type lithographic form plate was obtained in the same process as Example 1, except for using 2 part by weight of sensitizer A-8 instead of A-1.

Example 7

An electrophotography type lithographic form plate was obtained in the same process as Example 1, except for using 1 part by weight of sensitizer A-9 instead of A-1 and binder resin B-2 instead of B-1.

Comparative Example A (.dye with acid group different from that of the general formula (I))

An electrophotography type lithographic form plate was obtained in the same process as Example 1, except for using 3 parts by weight of sensitizer A-4 instead of A-1 and binder resin B-2 instead of B-1.

Comparative Example B (dye with acid group different from that of the general formula (I))

An electrophotography type lithographic form plate was obtained in the same process as Example 1, except for using 5 parts by weight of sensitizer A-5 instead of A-1.

Comparative Example C (dye with cyanin skeletal structure different from that of the general formula (I))

An electrophotography type lithographic form plate was obtained in the same process as Example 1, except for using 5 parts by weight of sensitizer A-6 instead of A-1 and binder resin B-2 instead of B-1.

Comparative Example D (dye with cyanin skeletal structure different from that of the general formula (I))

An electrophotography type lithographic form plate was obtained in the same process as Example 1, except for using 3 parts by weight of sensitizer A-7 instead of A-1 and binder resin B-2 instead of B-1.

Comparative Example E (resin having acid value lower than that of the binder resin according to the present invention)

An electrophotography type lithographic form plate was obtained in the same process as Example 1, except for using binder resin B-6 instead of B-1.

Comparative Example F (resin having acid value higher than that of the binder resin according to the present invention)

An electrophotography type lithographic form plate was obtained in the same process as Example 1, except for using binder resin B-7 instead of B-1.

Comparative Example G (resin having acid value higher than that of the binder resin according to the present invention).

An electrophotography type lithographic form plate was obtained in the same process as Example 1, except for using binder resin B-8 instead of B-1.

Electric characteristics of these samples were measured (while maintained in a dark place) one week and six months, respectively, after the same had been prepared, results of which are listed in Table 1. In addition, an image-forming ability was evaluated on an image carrying form plate has been formed, when the environmental change conditions for the image-formation are changed; and a printability is evaluated on tinting generating in a non-image area of the printed products in a single treatment of an etching processor having a low desensitization effect and on an image quality of the printed products through a durability test of 7000 sheets, results of which are listed in Table 2.

20° C. and 60% RH. Charging was carried out at a corona voltage of −6.5 kv and exposure was carried out by a monochromatic light having a wavelength to be measured and a light intensity of 5 $\mu W/cm^2$.

Charge amount (V5) is a potential at an instant 5 seconds after charging; sensitivity is the light quantity necessary for reducing the potential of charge to ½; a charge retaining factor is a value calculated by a formula of V60/V5×100%, in which V5 and V60 are potentials measured in a dark room at instants 5 and 60 seconds after charging, respectively; that is, a potential retaining ability after dark decay for 55 seconds.

TABLE 1

| | Sample | | Measured | Electrical Characteristics*2) | | | | | |
|---|---|---|---|---|---|---|---|---|---|
| | | | | Results one week after sample preparation | | | Results six months after sample preparation | | |
| | Dye kind | Resin kind: Acid value | wavelength (nm) | Charge amount V5 (−V) | Sensitivity E ½ | Dark decay retaining factor (%) | Charge amount V5 (−V) | Sensitivity E ½ | Dark decay retaining factor (%) |
| Example 1 | A-1 | B-1:5.2 | 780 | 650 | 30 | 84 | 630 | 29 | 83 |
| Example 2 | A-2 | B-1:6.1 | 780 | 600 | 24 | 86 | 580 | 25 | 82 |
| Example 3 | A-3 | B-3:8.0 | 670 | 630 | 32 | 85 | 620 | 31 | 81 |
| Example 4 | A-1 | B-4:3.3 | 780 | 580 | 28 | 76 | 540 | 27 | 74 |
| Example 5 | A-1 | B-5:9.7 | 780 | 570 | 34 | 79 | 520 | 32 | 73 |
| Comparative example A | A-4 | B-2:6.1 | 780 | 590 | 61 | 82 | 490 | 56 | 62 |
| Comparative example B | A-5 | B-1:5.2 | 780 | 470 | 119 | 76 | 420 | 100 | 68 |
| Comparative example C | A-6 | B-2:6.1 | 670 | 570 | 87 | 86 | 440 | 73 | 73 |
| Comparative example D | A-7 | B-2:6.1 | 780 | 430 | 46 | 59 | 400 | 43 | 40 |
| Comparative example E | A-1 | B-6:2.1 | 780 | 480 | 19 | 23 | 390 | 18 | 19 |
| Comparative example F | A-1 | B-7:11.3 | 780 | 470 | 40 | 82 | 450 | 38 | 65 |
| Comparative example G | A-1 | B-8:12.5 | 780 | 420 | 45 | 80 | 330 | 43 | 60 |
| Example 6 | A-8 | B-1:5.2 | 670 | 560 | 29 | 78 | 530 | 27 | 75 |
| Example 7 | A-9 | B-2:6.1 | 780 | 610 | 31 | 82 | 580 | 28 | 79 |

Remark 2) Electrical characteristics were measured by a static charge tester EPA-8100 (manufactured by K. K. Kawaguchi Denki Seisakusho) in a dark room maintained at

TABLE 2

| | | Image-forming ability and Printability | | | | | | | |
|---|---|---|---|---|---|---|---|---|---|
| | | Image Forming Ability*3) | | | | | | Printability*4) | |
| | | Normal 20° C., 60% RH | | High temp. % humidity 30° C., 80% RH | | Low temp. & humidity 10° C., 30 % RH | | Tinting in non-image | |
| | Resin kind: Acid value | Image density | Tinting in non-image area | Image density | Tinting in non-image area | Image density | Tinting in non-image area | area of printed product | Printing durability (sheet) |
| Example 1 | B-1:5.2 | 1.46 | o | 1.46 | o | 1.40 | o | o | 7000 |
| Example 4 | B-4:3.3 | 1.41 | o | 1.41 | o | 1.36 | o | o | 7000 |
| Example 5 | B-5:9.7 | 1.45 | o | 1.35 | o | 1.40 | o | o | 7000 |

TABLE 2-continued

| | | Image-forming ability and Printability | | | | | | | |
|---|---|---|---|---|---|---|---|---|---|
| | | Image Forming Ability*3) | | | | | | Printability*4) | |
| | | Normal 20° C., 60% RH | | High temp. % humidity 30° C., 80% RH | | Low temp. & humidity 10° C., 30 % RH | | Tinting in non-image | |
| | Resin kind: Acid value | Image density | Tinting in non-image area | Image density | Tinting in non-image area | Image density | Tinting in non-image area | area of printed product | Printing durability (sheet) |
| Comparative example E | B-6:2.1 | 1.40 | Δ | 1.36 | Δ | 1.18 | x | o | 3000 sensitive layer peeled off |
| Comparative example F | B-7:11.3 | 1.37 | o | 1.15 | x | 1.38 | o | Δ | 7000 |
| Comparative example G | B-8:12.5 | 1.35 | Δ | 1.05 | x | 1.37 | Δ | x | 5000 toner peeled off |

1 part by weight of sensitizer A-1 was used.

Remark 3) Image forming ability

An electrophotography type lithographic form plate thus obtained was conditioned in a dark place at 20° C. and 60% RH for 48 hours, then charged by a negative corona of −6 kv, and subjected to a scanning exposure by a semiconductor laser beam (light intensity of 3 mW/cm$^2$, wavelength of 780 nm) at a printing density of 600 DPI in accordance with a predetermined pattern. Thereafter, it was developed by a positive charge liquid toner AP-10 set (manufactured by Iwasaki Tsushinki K. K.) to be an image carrying form plate.

An image density is a value obtained by measuring a solid portion of the image carrying form plate with a Macbeth reflective densiometer RD-514 (manufactured by U.S. Macbeth Corp.). The higher the value, the higher the image density.

Tinting in non-image area was evaluated on the non-image area of the image carrying form plate by human eye. The results were classified into ○: good, Δ: slight tinting, and x: bad.

Remark 4) Printability

An image carrying form plate was prepared at 20° C. and 60% RH and subjected to a desensitization treatment while using V-etch liquid (marketed by Iwasaki Tsushinki K. K.) as a desensitization treatment liquid through a single processing of an etching processor (manufactured by Ricoh K. K.). A printing was carried out by using this lithographic form plate in a printer Besty-4700CD (manufactured by Tokyo Koku Keiki K. K.).

Tinting in non-image area was evaluated by human eye on a printed product. The results were classified into ○: good, Δ: slight tinting, and x: bad.

Printing durability was evaluated during the printing operation of 7000 sheets in the same manner as evaluating tinting of non-image area while using a lithographic form plate prepared at 20° C. and 60% RH and subjected to a desensitization treatment by a hand etching of V-etch liquid, by determining the upper limit of the number of sheets within which the deterioration of image quality of the printed product is permissible. The larger the number of sheets, the better the printing durability.

As apparent from Table 1, Examples 1 through 7 have an excellent electric characteristics of high sensitivity, charge amount and charge retaining factor, which are hardly deteriorated even after six months, whereby a shelf stability is satisfactory.

As shown in FIG. 2, Examples 1, 4 and 5, the image-forming ability, the image density and tinting in non-image area were useable even though the environmental conditions are changed, and, as for printability, tinting in non-image area of the printed product was not at all apparent, even if the form plate is prepared by a single treatment of an etching processor having a lower desensitization effect, whereby the printing operation can be satisfactorily carried out on more than 7000 sheets.

Comparative Example A using a sensitizer having an acid group (—$SO_3Na$) different from that of the general formula (I) according to the present invention has a high charge amount and charge retaining factor but has a low sensitivity regarding the electric characteristics. In addition, these characteristics are reduced after six months, which means that the shelf-life is inferior.

Comparative Example B using a sensitizer having the number of carbon atoms in acid group (—$CH_2COOH$) different from that of the general formula (I) according to the present invention has a relatively good shelf stability but has a low sensitivity and charge amount electrical characteristics.

Comparative Example C using cyanin dye skeletal structure different from that of the general formula (I) according to the present invention has a high charge amount and charge retaining factor but has a low sensitivity. In addition, these characteristics are reduced to a great extent after six months, which means that the shelf-life is inferior.

Comparative Example D using cyanin dye skeletal structure different from that of the general formula (I) according to the present invention has a relatively good shelf stability but has a poor charge amount and charge retaining factor.

Comparative Example E using a binder resin having a total acid value lower than that of the binder resin according to the present invention has a high sensitivity but a poor charge retaining factor and an inferior image-forming ability at lower temperature and humidity and a poor printing durability.

Comparative Examples F and G using a binder resin having a total acid value higher than that of the binder resin according to the present invention has a good charge retaining factor but a poor charge amount value. In addition, the shelf-life thereof is low because the charge retaining factor after six months is reduced. Also the image forming ability at high temperature and humidity and the tinting in non-image area values are low.

From the above facts, the electrophotography type lithographic form plate having a high sensitivity to a light with a measured wavelength (780 nm or 670 nm) and satisfying all of the electric characteristics, shelf stability, image forming ability and printability criteria can only be obtained by Examples in which a sensitizer and binder resin according to the present invention are used.

According to the present invention, an electrophotography type lithographic form plate can be obtained which is highly photo-sensitive to a semiconductor laser beam with wavelength of 780 nm and 670 nm and has a superior image forming ability, electric characteristics, stability against the environmental change and shelf-life, as well as having a satisfactory printability.

As stated above, it is possible to form a printing plate directly from a computer while using a semiconductor laser beam, whereby a process for forming a block copy can be eliminated. Also the resulting form plate can be used in a similar manner as a conventional electrophotography type lithographic form plate.

We claim:

1. An electrophotography lithographic form plate for a laser beam comprising an electroconductive support member and a photosensitive layer formed thereon, said photosensitive layer consisting essentially of 100 parts by weight of zinc oxide, 10–50 parts by weight of a binder resin having a total acid value of 3.0–10.0, and 0.001–0.03 parts by weight of a sensitizer selected from the group consisting of dye compounds represented by the formula:

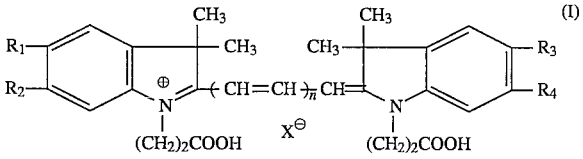

(I)

wherein n is 2 or 3; $R_1$, $R_2$, $R_3$ and $R_4$ are independently a hydrogen atom, lower alkyl group, lower alkoxy group or halogen atom; and X– is an acid anion.

2. An electrophotography lithographic form plate as defined by claim 1, wherein, n represents 3; $R_1$ and $R_3$ represent methyl groups; $R_2$ and $R_4$ represent hydrogen atoms; and X–represents an iodine ion.

3. An electrophotography lithographic form plate as defined by claim 1, wherein n represents 3; $R_1$, $R_2$, $R_3$ and $R_4$ represent hydrogen atoms; and X represents an iodine ion.

4. An electrophotography lithographic form plate as defined by claim 1, wherein n represents 3; $R_1$ and $R_3$ represent methoxy groups; $R_2$ and $R_4$ represent hydrogen atoms; and X represents an iodine ion.

5. An electrophotography lithographic form plate as defined by claim 1, wherein the total acid value of the binder resin is in a range of 5.0 through 8.0.

6. An electrophotography lithographic form plate as defined by claim 1, wherein the total acid value of the binder resin is in a range of 4.0 through 9.0.

7. An electrophotography lithographic form plate as defined by claim 1, wherein the sensitizer comprises 0.003–0.02 parts by weight relative to the 100 parts by weight of the zinc oxide.

8. An electrophotography lithographic form plate as defined by claim 1, wherein the binder resin comprises 15–30 parts by weight relative to the 100 parts by weight of the zinc oxide.

9. An electrophotography lithographic form plate for a laser beam comprising an electroconductive support member and a photosensitive layer formed thereon, said photosensitive layer consisting essentially of 100 parts by weight of zinc oxide, 10–50 parts by weight of a binder resin having a total acid value of 3.0–10.0, and 0.001–0.03 parts by weight of a sensitizer selected from the group consisting of dye compounds represented by the formula:

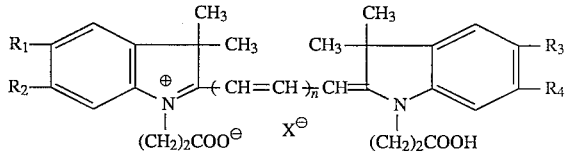

wherein n is 2 or 3; and $R_1$, $R_2$, $R_3$ and $R_4$ are independently a hydrogen atom, lower alkyl group, lower alkoxy group or halogen atom.

10. An electrophotography lithographic form plate as defined by claim 9, wherein n represents 2; and $R_1$, $R_2$, $R_3$ and $R_4$ represent hydrogen atoms salt.

11. An electrophotography lithographic form plate as defined by claim 9, wherein n represents 3; $R_1$and $R_3$ represent hydrogen atoms; and $R_2$ and $R_4$ represent chlorine atoms.

12. An electrophotography lithographic form plate as defined by claim 9, wherein the total acid value of the binder resin is in a range of 4.0 through 9.0.

13. An electrophotography lithographic form plate as defined by claim 9, wherein the total acid value of the binder resin is in a range of 5.0 through 8.0.

14. An electrophotography lithographic form plate as defined by claim 9, wherein the sensitizer comprises 0.003–0.02 parts by weight relative to the 100 parts by weight of the zinc oxide.

15. An electrophotography lithographic form plate as defined by claim 9, wherein the binder resin comprises 15–30 parts by weight relative to the 100 parts by weight of the zinc oxide.

* * * * *